United States Patent [19]

Drohomirecky

[11] 3,951,409

[45] Apr. 20, 1976

[54] BACKBOARDS WITH HOOPS THEREON AND SCOREBOARD

[75] Inventor: Walter Drohomirecky, Rankin, Pa.

[73] Assignee: The Raymond Lee Organization, Inc., New York, N.Y. ; a part interest

[22] Filed: Dec. 14, 1972

[21] Appl. No.: 315,026

[52] U.S. Cl. ..... 273/95 H; 273/105 R; 273/85 H; 273/1.5 R

[51] Int. Cl.[2] ..... A63B 71/02

[58] Field of Search ..... 273/1.5 R, 85 R, 95 R, 273/95 H, 101, 102 R, 102 S, 105 R

[56] References Cited

UNITED STATES PATENTS

| | | | |
|---|---|---|---|
| 1,534,390 | 4/1925 | Horton | 273/88 |
| 1,996,986 | 4/1935 | Weinberg | 273/105 R |
| 2,926,914 | 3/1960 | Miller | 273/105 R |
| 2,939,707 | 6/1960 | Lemelson | 273/105 R |
| 3,035,838 | 5/1962 | Johnston | 273/105 R |
| 3,137,503 | 6/1964 | Ballard | 273/95 R |
| 3,511,503 | 5/1970 | Volpe | 273/105 R |

*Primary Examiner*—Richard J. Apley
*Assistant Examiner*—Marvin Siskind
*Attorney, Agent, or Firm*—Howard I. Podell

[57] ABSTRACT

A game in which players competitively throw or roll a ball against an inclined backboard so as to make the ball fall through a hoop on an adjacent inclined backboard. The game comprises a flat board which may also be used as a scoreboard, and two portable stands on each of which a horizontal hoop is mounted on a flat surface which is inclined to the vertical. The game may be played by separating the two stands so that their inclined faces and hoops face each other. Each player, in turn, attempts to throw or roll a ball against the inclined face of his opponent's stand so as to cause the ball to fall through the hoop mounted on his own stand. Alternately the two stands may be placed side-by-side, facing in the same direction, with the scoreboard placed between the two stands and resting on the inclined faces. In this latter form of the game, each player in turn attempts to throw or roll the ball against the scoreboard so as to cause the ball to fall through his own hoop.

1 Claim, 5 Drawing Figures

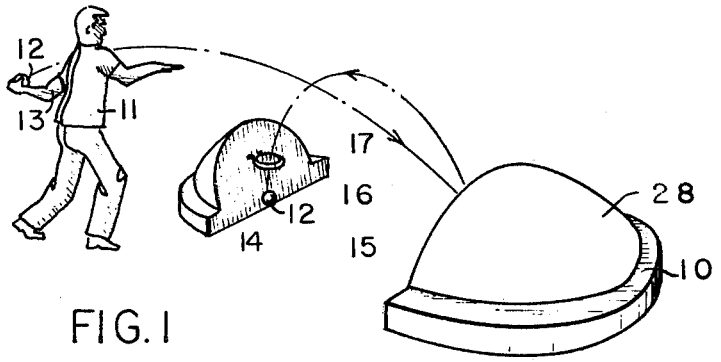
FIG. 1
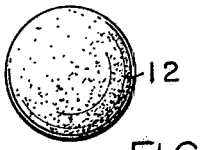
FIG. 2
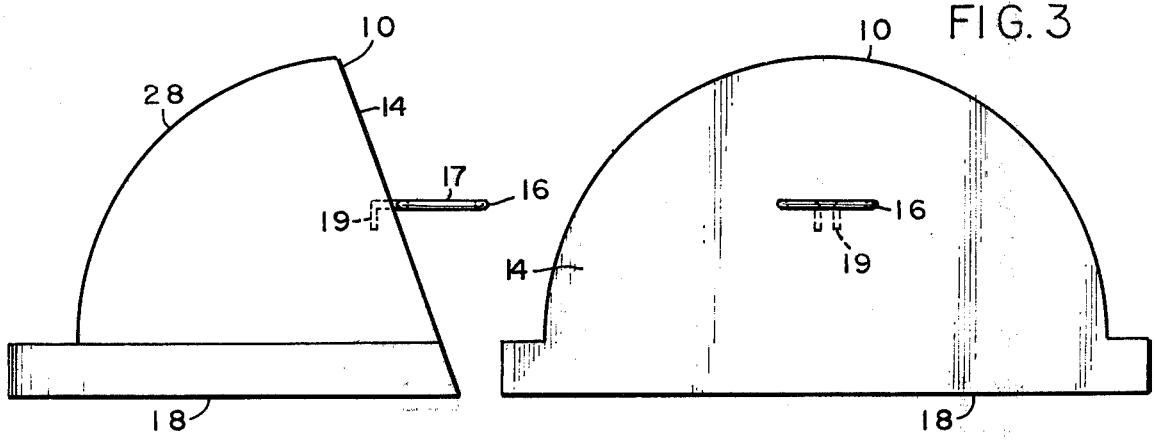
FIG. 3
FIG. 4
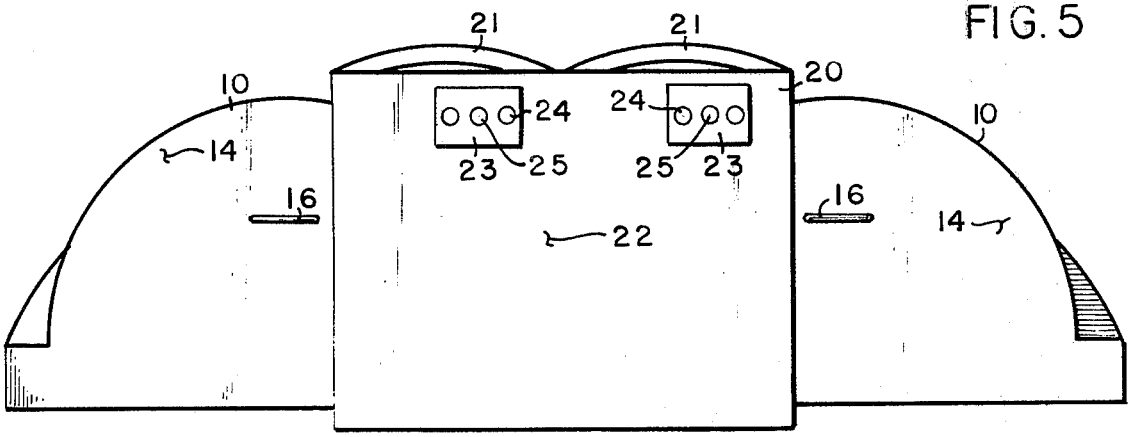
FIG. 5

BACKBOARDS WITH HOOPS THEREON AND SCOREBOARD

SUMMARY OF THE INVENTION

This invention relates to a game in which competitors throw or roll a ball against an inclined surface and into a horizontal hoop, and particularly to such a game which is played with portable pieces of equipment.

The advantage of this game is that it encourages the players to improve their manual dexterity in an enjoyable competitive game, utilizing portable equipment which may be readily relocated in various positions in accordance with the skill of the players.

The game includes two stands, each of which is formed with a flat surface which is inclined to the vertical, when the stand is resting on a horizontal surface. An open circular hoop lying in the horizontal plane is fixed on each inclined surface. A ball, which is of smaller diameter than that of the hoops, is thrown or rolled at the inclined surface of one of the stands so as to fall through the open hoop of the other stand, with both stands located so that the inclined surfaces face each other. Alternately, the stands may be located, side-by-side, facing in the same direction with a flat board placed on the adjoining inclined surfaces. Each player attempts to throw or roll the ball so as to fall into the hoop of his inclined stand.

BRIEF DESCRIPTION OF THE DRAWINGS

The objects and features of the invention may be understood with reference to the following detailed description of an illustrative embodiment of the invention taken together with the accompanying drawings in which:

FIG. 1 is a perspective view of a player throwing a ball against the inclined surface of one stand so as to cause the ball to fall through the hoop of the other stand;

FIG. 2 is a perspective view of the ball;

FIG. 3 is an elevation view of a stand;

FIG. 4 is a side view of a stand; and

FIG. 5 is an elevation view of the two stands arranged side-by-side, with a flat scoreboard resting on the inclined surfaces of both stands, for use in an alternate version of the game.

DESCRIPTION OF THE PREFERRED EMBODIMENT

Turning now descriptively to the drawings, in which similar reference characters denote similar elements throughout the several views, FIG. 1 illustrates a player 11 throwing a ball 12 with his arm 13 so that the ball 12 will strike the inclined surface 14 of one stand 10 and fall into the circular hole 17 formed by the open horizontal hoop 16 mounted on the inclined face 14 of the other stand as shown by the dotted lines, with both stands 10 located on a horizontal ground surface 15, and with the inclined surfaces 14 of each stand facing the other.

The ball 12 shown in FIG. 2 is of a size to fit readily through the hole 17 of the hoops 16 mounted on the stands 10.

As shown in FIG. 1 and FIG. 3—4, each stand 10 is formed with a flat bottom surface 18 which forms an acute angle with an inclined surface 14 of the stand 10. A wire hoop 16 is mounted on the face of the stand so that the plane of the hoop 16 is located parallel to the plane of the stand bottom surface 18, with angled hoop ends 19 fastened into the interior of the stand to hold the hoop 16 permanently in position.

The rear surfaces 28 of each stand 10 may be formed in a sperical shape to avoid projecting corners which might obstruct the passage of a thrown ball.

An alternate configuration of the game is shown in FIG. 5 in which two stands 10 are placed side-by-side with their inclined surfaces facing in the same direction. A flat scoreboard 20 is rested on the adjoining inclined surfaces 14 of the stands 10. Scoreboard 20 may be have circular handles 21 mounted to the top edges and is fitted with score sections 23, with three circular dial faces 24 marked in score points and with a movable rotatable pointer 25 located in the center of each dial face 24 for the purpose of recording the score of each player. The scoreboard 20 otherwise is formed with a flat exterior surface 22, the back of which is placed against the inclined surfaces 14 of the stands 10. Each player, in turn, seeks to throw or roll the ball 12 against the surface 22 of the scoreboard 20 so as to cause the ball 12 to fall through the hole 17 of the hoop 16 of his respective stand 10.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A game in which players may competitively project a ball against an inclined surface so as to cause the ball to fall through an open circular hoop mounted on a second inclined surface, comprising a ball and a pair of inclined stands, each inclined stand consisting of a structure on which a flat inclined surface is mounted at an acute angle to the bottom plane of the structure to which it is joined along a continuous line, with a wire circular open hoop mounted on said inclined surface, the plane of the hoop being generally parallel to the bottom plane of the structure, said wire hoop being located with regard to said inclined surface so that the surface extends above, below and on both sides of the hoop to provide a rebound surface for a ball which is either thrown or rolled against the surface, together with a flat scoreboard which is rested on the inclined surface of both stands located side-by-side and facing in the same direction, with two or more circular dial faces marked on the surface of the scoreboard in numberals, said scoreboard also serving as a rebound surface to a thrown or rolled ball projected against the scoreboard surface so as to cause a properly aimed ball to fall through one of the hoops mounted on one of the two adjoining stands.

* * * * *